US007581370B2

(12) United States Patent
Koga

(10) Patent No.: US 7,581,370 B2
(45) Date of Patent: Sep. 1, 2009

(54) METHOD AND APPARATUS FOR FEEDING BAGS TO A PACKAGING MACHINE

(75) Inventor: Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 12/217,232

(22) Filed: Jul. 2, 2008

(65) Prior Publication Data

US 2009/0013651 A1 Jan. 15, 2009

(30) Foreign Application Priority Data

Jul. 10, 2007 (JP) ..... 2007-180762

(51) Int. Cl.
*B65B 43/04* (2006.01)
*B65B 1/30* (2006.01)
*B65G 43/08* (2006.01)
*B31B 49/04* (2006.01)

(52) U.S. Cl. ..... 53/455; 53/493; 53/393; 493/29; 493/198; 493/227; 493/267; 198/401; 198/410; 271/69

(58) Field of Classification Search ..... 53/443, 53/446, 455, 493, 562, 202, 393; 493/29, 493/8, 194, 196, 198, 199, 227, 267; 198/400, 198/401, 406, 409, 410, 377.04; 271/69
See application file for complete search history.

(56) References Cited

U.S. PATENT DOCUMENTS 4,531,343 A * 7/1985 Wood ..... 53/399
4,617,785 A * 10/1986 Chikatani et al. ..... 53/562
4,726,170 A * 2/1988 Sawa et al. ..... 53/570
5,058,364 A * 10/1991 Seiden et al. ..... 53/455
5,335,478 A * 8/1994 Aronsen ..... 53/412
5,771,657 A * 6/1998 Lasher et al. ..... 53/55
6,186,933 B1 * 2/2001 DeMatteis ..... 493/193
6,422,375 B1 * 7/2002 Hellman et al. ..... 198/408
6,945,531 B2 * 9/2005 Perobelli et al. ..... 271/270
7,021,036 B2 * 4/2006 Hiramoto et al. ..... 53/562
2001/0015056 A1 * 8/2001 Hiramoto et al. ..... 53/479
2008/0041695 A1 * 2/2008 Cremers et al. ..... 198/400

FOREIGN PATENT DOCUMENTS

EP 1 447 331 8/2004

(Continued)

*Primary Examiner*—Paul R Durand
(74) *Attorney, Agent, or Firm*—William L. Androlia; H. Henry Koda

(57) ABSTRACT

A bag-making and packaging machine, in which a horizontal bag-making machine and a packaging machine are provided, including a positioning conveyor for positioning bags fed out from the horizontal bag-making machine, a feed conveyor for feeding the bags to the packaging machine, and first, second, and third transport mechanisms provided between the positioning conveyor and the feed conveyor. The first transport mechanism lifts up the bags up and change their attitude to a vertical attitude with the bag mouths oriented upward. The second transport mechanism receives the bags from the first transport mechanisms, transports them, and rotates the bags to orient bag surfaces in the feed direction of the feed conveyor. The third transport mechanisms receives the bags from the second transport mechanisms, changes their attitude to a horizontal attitude, and places them on the feed conveyor with the bag mouths oriented in the feed direction.

8 Claims, 8 Drawing Sheets

FOREIGN PATENT DOCUMENTS

| | | |
|---|---|---|
| JP | 3105568 | 12/1992 |
| JP | 2002-036392 | 2/2002 |
| JP | 2002-308223 | 10/2002 |
| JP | 2004-042447 | 2/2004 |
| JP | 2004-244085 | 9/2004 |
| JP | 2006-111346 | 4/2006 |
| JP | 3840255 | 11/2006 |

* cited by examiner

METHOD AND APPARATUS FOR FEEDING BAGS TO A PACKAGING MACHINE

BACKGROUND OF THE INVENTION

1. Field of the Invention

The present invention relates to a method and an apparatus for, in a bag-making and packaging machine in which a horizontal bag-making machine and a packaging machine are provided together and operate together, successively feeding bags manufactured by the horizontal bag-making machine to the belt conveyor of a conveyor magazine-type bag feeder of the packaging machine, without temporarily stocking the bags.

2. Description of the Related Art

A horizontal bag-making machine manufactures bags by: rewinding a belt-shaped film from a film roller of which axle is set horizontally; folding this belt-shaped film while feeding it in the longitudinal direction; effecting seals at places corresponding to the bag bottom and sides by a sealing device while intermittently feeding this belt-shaped film in the longitudinal direction in a horizontal plane while it is made to lie flush down laterally, thus forming connected bags connected in a belt shape; and then cutting and separating the individual bags from the tip end of the connected bags. Among such machines, there are a one-row type machine (wherein there is one row of connected bags) as described in, for example, Japanese Patent Application Laid-Open (Kokai) Nos. 2004-42447, 2004-244085 and 2006-111346, and a two-row type machine (wherein there are two rows of connected bags, and two bags are fed out in parallel) as described in Japanese Patent Nos. 3840255 and 3105568.

On the other hand, among packaging machines, there are those in which two bag feeders are provided as described in Japanese Patent Application Laid-Open (Kokai) Nos. 2004-42447 and 2004-244085, those in which only one bag feeder is provided as described in Japanese Patent Application Laid-Open (Kokai) No. 2006-111346 and Japanese Patent No. 3105568, and those in which four bag feeders are provided as described in Japanese Patent Application Laid-Open (Kokai) No. 2002-308223. The packaging machines receive one bag at a time from one of or from each one of a plurality of bag feeders, respectively (receiving a plural number of bags simultaneously if there is a plural number of bag feeders), and, at the same time, implement packaging processes.

In the bag-making and packaging machines described in Japanese Patent Application Laid-Open (Kokai) Nos. 2004-42447, 2004-244085 and 2006-111346, the orientation of the bags (the direction in which the bag mouth opens) manufactured by the bag-making machine and the orientation of the bags in the bag feeders of the packaging machines are aligned. As a consequence, the bags manufactured by the bag-making machines can be sent to the bag feeders of packaging machines as they are without changing the orientation thereof.

In a bag-making and packaging machine, it is common to provide the bag-making machine and the packaging machine so that the orientation of the bags manufactured by the bag-making machine and the orientation of the bags in the bag feeder of the packaging machine are aligned. However, in some cases, due to layout limitations in a factory, these orientations cannot be aligned. Furthermore, the horizontal bag-making machines of high processing power are generally of the two-row type or of the four row type (2 rows×2); and in these horizontal bag-making machines, as described in, for example, Japanese Patent No. 3840255, the bags manufactured face different orientations (so that the bag mouths face each other). In such cases, some means for changing orientations of the bags become necessary between the bag-making machine and the bag feeder.

Furthermore, just as there are one-row types, two-row types, and four-row types and the like in bag-making machines, in packaging machines, there are those that have one bag feeder and those that have a plural number of bag feeders. When such a bag-making machine and a packaging machine are combined to form a bag-making and packaging machine and are operated together (so that the number of bags made by the bag-making machine and the number of processes effected by the packaging machine coincide), it is of course possible that the number of rows of bags fed out from the bag-making machine and the number of bag feeders would be different. In such a case, some means become necessary between the bag-making machine and the bag feeders for compensating for the difference between the number of rows and the number of machines, so that bags will be supplied uniformly to all of the bag feeders.

The above-described Japanese Patent Application Laid-Open (Kokai) Nos. 2004-42447 and 2004-244085 disclose bag-feeding packaging machines in which a one-row bag-making machine and a packaging machine having two bag feeders are combined together. In either publications, however, there is no disclosure on what to do in the case that the orientation of bags manufactured by the bag-making machine and the orientation of bags in the bag feeder of the packaging machine are different or on the case that a two-row bag-making machine is employed.

On the other hand, the above-described Japanese Patent No. 3105568 discloses a bag-making and packaging machine in which a two-row bag-making machine and a packaging machine having one bag feeder are combined. However, the invention of this publication is limited to a means for changing two rows to one row, and it is presupposed that the orientation of the bags manufactured by the bag-making machine and the orientation of the bags in the bag feeder of the packaging machine coincide. Furthermore, the invention is for a type of apparatus that stacks and bundles the bags to stock them, and no consideration is given to applications for conveyor magazine-type bag feeders.

BRIEF SUMMARY OF THE INVENTION

Accordingly, an object of the present invention is to provide a bag-making and packaging machine that comprises a horizontal bag-making machine and a packaging machine that are installed together and operate together, wherein bags manufactured by, in particular, the horizontal bag-making machine can be fed successively to the belt conveyor of a conveyor magazine-type bag feeder of the packaging machine, without temporarily stocking them, irrespective of whether the orientation of the bags manufactured by the bag-making machine and the orientation of the bags in the bag feeder of the packaging machine are different or are the same, and irrespective of the number of rows of bags fed out from the bag-making machine.

The above object is accomplished by unique steps of a method of the present invention for feeding bags to a packaging machine, and the method of the present invention comprises the steps of:

- forming connected bags, in which bags are connected in a belt shape, in a horizontal bag-making machine while a belt-shaped film is fed, successively, in its longitudinal direction;
- cutting and separating individual bags from the connected bags in the horizontal bag-making machine;

allowing the bags fed out from the horizontal bag-making machine to be received on a conveyor and conveyed and then effecting positioning of the bags at a prescribed position on the conveyor;

upwardly pulling out the positioned bags, and changing attitudes of the bags to a vertical attitude in which the bag mouths are oriented upward;

moving the bags in a horizontal direction, toward a prescribed position, while the vertical attitude of the bags is maintained;

rotating the bags to orient one bag surface toward a next feed direction;

changing the attitude of the bags from vertical to horizontal so that the bag mouths are oriented in the feed direction, and placing the bags on a feed conveyor; and then conveying and feeding the bags on the feed conveyor toward a belt conveyor of a conveyor magazine-type bag feeder of the packaging machine.

In this method, the step of moving the bags in a horizontal direction, toward a prescribed position, while the vertical attitude thereof is maintained and the step of rotating the bags to orient one bag surface toward a next feed direction are executed in this order, but they can be executed simultaneously.

Furthermore, the above object is accomplished also by a unique structure of the present invention for an apparatus for feeding bags to a packaging machine, and in the present invention, the apparatus for feeding bags comprises:

a horizontal bag-making machine for forming connected bags such that bag are connected in a belt shape, while feeding a belt-shaped film, successively, in a longitudinal direction of the film and for cutting and separating individual bags from said connected bags;

a positioning conveyor for conveying and successively feeding bags fed out from the horizontal bag-making machine and positioning the bags in a prescribed position;

a feed conveyor for conveying bags manufactured by the horizontal bag-making machine toward a belt conveyor of a conveyor magazine-type bag feeder of a packaging machine and successively feeding the bags; and a first, second, and third transport means provided between the positioning conveyor and the feed conveyor, wherein the first transport means comprises a swing arm that swings up and down in a vertical plane, and a suction member(s) provided on the swing arm and capable of sucking onto a bag surface, so that the first transport means upwardly pulls out bags positioned on the positioning conveyor, and changes the attitude of the bags to a vertical attitude with bag mouth oriented upward;

the second transport means comprises a transport arm that swings in a horizontal plane, a support member provided in the transport arm so as to turn in a horizontal plane, and a bag-clamping member(s) provided in the support member and capable of opening and closing, so that the second transport means clamps onto and receives bags held in the vertical attitude by the suction member(s), transports the bags toward a prescribed position while the bags are still being held in the vertical attitude, and rotates the bags to orient a bag surface thereof in the feed direction of the feed conveyor; and the third transport means comprises a swing arm that swings up and down in a vertical plane, and a suction member(s) provided in the swing arm and capable of sucking onto the bag surface, so that the third transport means sucks onto and receives bags held in the vertical attitude by the bag-clamping member(s), changes the attitude of the bags to a horizontal attitude, orients the bag mouths in the feed direction of the feed conveyor, and places the bags on the feed conveyor.

In terms of a specific embodiment in which consideration is given to actual horizontal bag-making machines and packaging machines, in the present invention:

the horizontal bag-making machine forms connected bags in A rows (where A is 1 or 2), then cuts and separates individual bags from the connected bags;

B bags (where B is an integer that is 1 or 2 or greater) are positioned, in the positioning conveyor, along a conveyance direction of the positioning conveyor, for each row of bags fed out from the horizontal bag-making machine;

the conveyor magazine-type bag feeder is provided in a number equal to A×B;

the feed conveyor is provided corresponding to the belt conveyor of each conveyor magazine-type bag feeder;

the first and second transport means are respectively provided in A groups so as to correspond to the rows of bags fed out from the horizontal bag-making machine;

a suction member(s) is provided in the swing arm of each of the first transport means corresponding to the B bags positioned along the conveyance direction on the positioning conveyor;

a bag-clamping member(s), corresponding to the B bags sucked onto by a suction means of the first transport means, is provided in the support member of each of the second transport means; and a suction member(s), corresponding to the A×B number of bags held by the bag clamping means, is provided in the swing arm of the third transport means.

It is, in the above-described apparatus of the present invention, preferable that the positioning conveyor comprise B small sub-conveyors provided in series in the conveyance direction, and bags are positioned on each sub-conveyor one at a time.

As seen from the above, the present invention provides a bag-making and packaging machine in which bags manufactured by a horizontal bag-making machine are successively fed to the belt conveyor of a conveyor magazine-type bag feeder of a packaging machine, without temporarily stocking them. This bag-making and packaging machine can be configured from the horizontal bag-making machine and the packaging machine, irrespective of whether the orientation of the bags manufactured by the bag-making machine and the orientation of the bags in the bag feeder of the packaging machine are different or are the same, and irrespective of the number of rows of bags fed out from the bag-making machine. In the present invention, accordingly, efficient bag feeding is performed to the packaging machine without the production capabilities of the horizontal bag-making machine and packaging machine being curtailed. Furthermore, another advantage of the present invention is that a mechanism for changing the bag orientation and adjusting the number of rows is simple.

Furthermore, the present invention is applicable not only to a case in which the number of rows of bags manufactured by the horizontal bag-making machine is smaller than the number of conveyor magazines in the packaging machine but also to a case in which the number of rows of bags manufactured are the same as or greater than the number of conveyor magazines.

DETAILED DESCRIPTION OF THE INVENTION

Concrete descriptions of the method and apparatus for feeding bags to a packaging machine according to the present invention will be now given below with reference to FIGS. 1 to 8.

Figure 1:
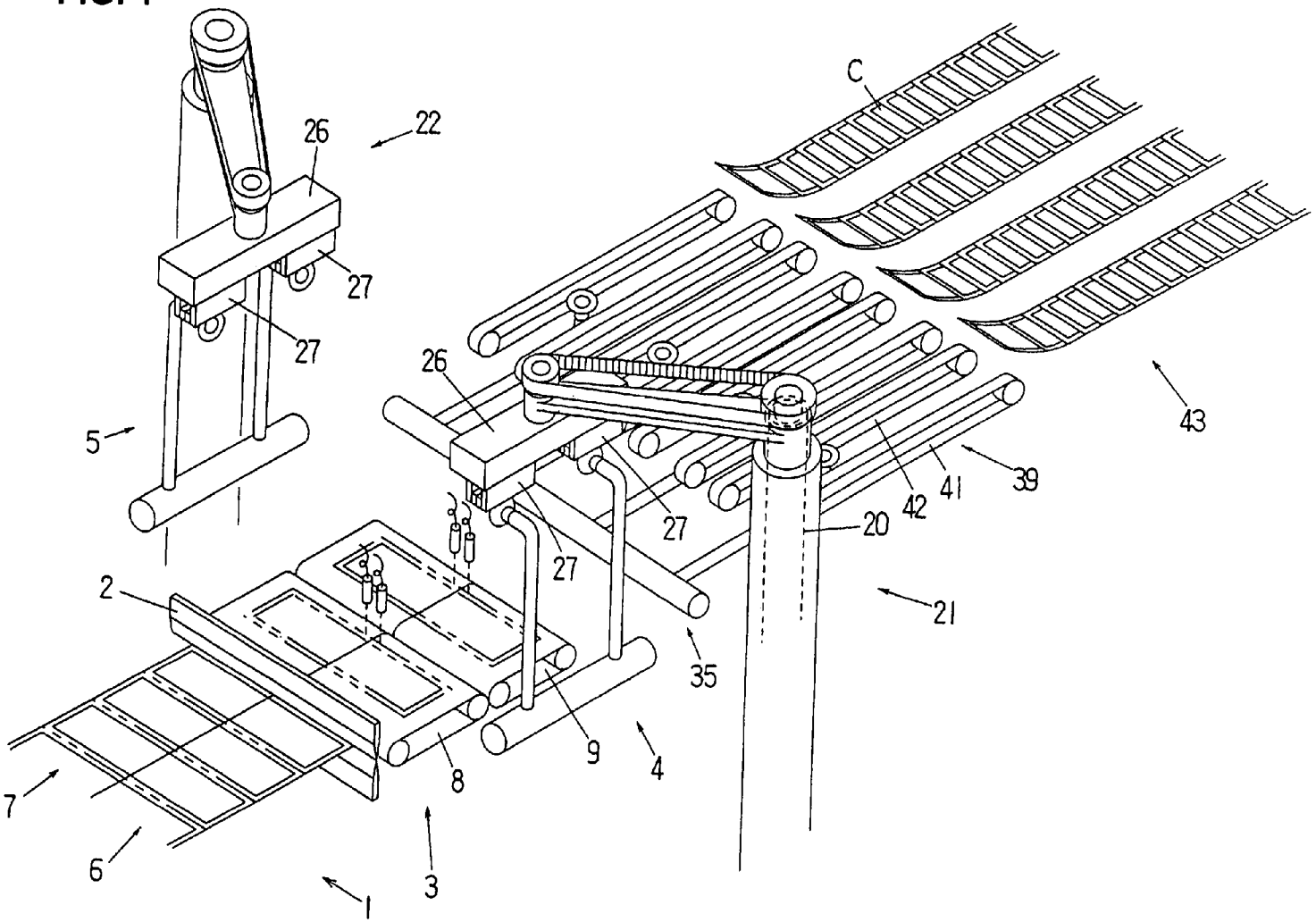
FIG. 1 is an overall perspective view of a bag feeding apparatus according to the present invention.

FIG. 1 is an overall perspective view of an apparatus for feeding bags to a packaging machine.

In the bag feeding apparatus of FIG. 1, the horizontal bag-making machine (only cutter blades thereof shown) is of the type (two-row type) which forms connected bags in two rows and feeds out two bags in parallel, wherein the two bags fed out simultaneously have their bag mouths facing each other. This type of horizontal bag-making machine is publicly known and described in, for example, the above-described Japanese Patent No. 3840255. On the other hand, the packaging machine (the packaging machine itself is not shown, and only the groups of bags stacked on the belt conveyors of the conveyor magazine-type bag feeders that feed the bags are shown) comprises four conveyor magazine-type bag feeders, and it receives four bags at one time and performs various packaging processes. This type of packaging machine is also publicly known and described in, for instance, the above-described Japanese Patent Application Laid-Open (Kokai) No. 2002-308223.

The above-described horizontal bag-making machine and packaging machine are installed in such a configuration that the conveyance direction of the belt conveyor of the conveyor magazine-type bag feeders of the packaging machine coincides with the direction in which the bags are fed out by the horizontal bag-making machine.

Accordingly, the orientation of the bags manufactured and fed out by the horizontal bag-making machine and the orientation of the bags in the conveyor magazine-type bag feeders (the orientation of the bags fed to the belt conveyors) differ by 90 degrees, while the orientations of the bags themselves fed out in parallel rows differ by 180 degrees. The number of the bags fed out at one time from the horizontal bag-making machine is two, while the number of belt conveyors in the conveyor magazine-type bag feeders is four (so that the number of bags that can be fed in at one time is four).

The elements that make the apparatus according to the present invention will be described in detail with reference to FIGS. 2 to 8.

Figure 2:
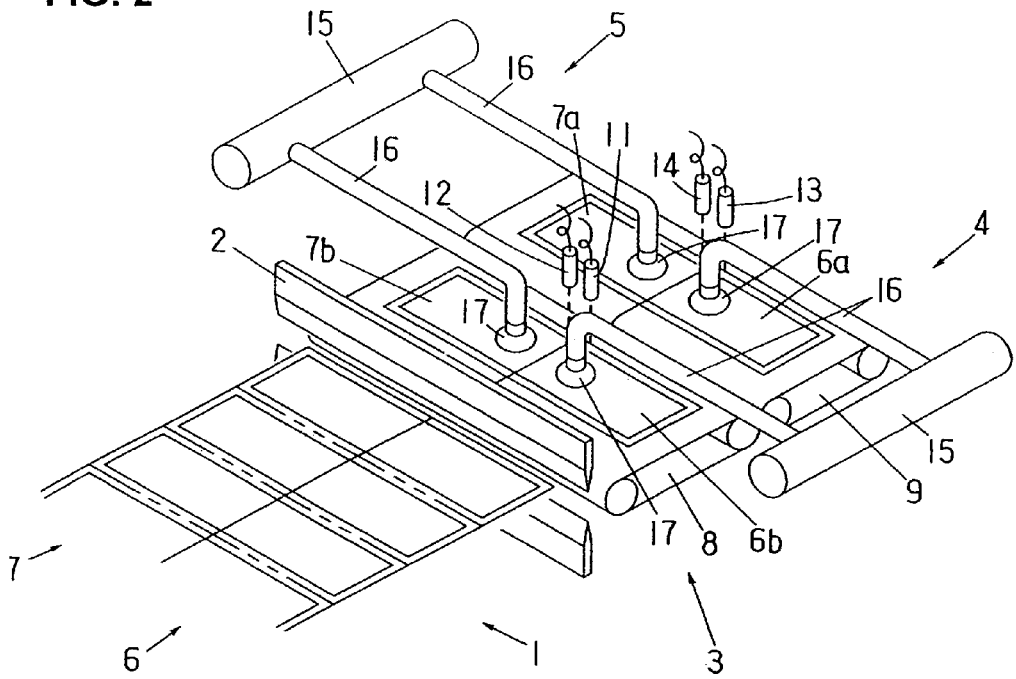
FIG. 2 is a diagram showing, in process step order, the actions of the method and apparatus of the present invention, mainly showing the first transport means.

FIG. 2 shows a portion (only the cutter blades 2) of a horizontal bag-making machine 1, and first transport means 4 and 5 of a positioning conveyor 3.

More specifically, in the horizontal bag-making machine 1, two rows of connected bags 6 and 7 in which the bags, with the places that will be their bottoms and sides sealed, are connected in a belt shape (at which point the connected bags 6 and the connected bags 7 are separated from each other) are formed while being intermittently transported forward, and, at each intermittent stopping, one bag is each cut by a pair of cutter blades 2, which open and close (or make contact and separate) up and down, and separated, respectively, from the tip ends of the connected rows of bags 6 and 7. The connected bags 6 and 7 are, as mentioned above, separated in the longitudinal (length-wise) direction in the center of the film, and, thereby, the bag mouths are formed; and the bag mouths of the bags are facing each other.

Just beyond the cutter blades 2 (or on the downstream side of the cutter blades 2), the positioning conveyor 3 for positioning bags 6*a*, 7*a*, 6*b* and 7*b* separated from the connected bags 6 and 7 is provided. The positioning conveyor 3 comprises two small sub-conveyors (a first conveyor 8 and a second conveyor 9) that are provided in series with each other and so that the conveyance direction thereof is parallel to the direction of transport of the connected bags 6 and 7 in the horizontal bag-making machine 1. The first and second conveyors 8 and 9 respectively include mutually independent drive mechanisms, so that they begin their operation immediately after the actions of the respective cutter blades 2 (bag separation) and then stop their operation based on detection signals from first detection sensors 11 and 12 and second detection sensors 13 and 14. The first and second conveyors 8 and 9 are set so that they begin one action for every two actions of the cutter blades 2.

The series of steps up to the point where the bags are separated from the connected bags 6 and 7 and positioned two at a time (bags 6*a*, 7*a*, 6*b* and 7*b*) on the first and second conveyors 8 and 9 will be described next. First, the bags 6*a* and 7*a* that have arrived and stopped on the belt of the first conveyor 8 in conjunction with the transporting of the connected bags 6 and 7 are cut and separated from the connected bags 6 and 7 by the cutter blades 2 (see FIG. 3), and then the first and second conveyors 8 and 9 are activated and convey the bags 6*a* and 7*a* forward. During this time, the forward transporting of the connected bags 6 and 7 is begun, then stopped, and the next bags 6*b* and 7*b* are cut and separated from the connected bags 6 and 7 by the cutter blades 2 (see FIG. 4). While the bags 6*b* and 7*b* are being conveyed by the first conveyor 8 and the bags 6*a* and 7*a* are being conveyed by the second conveyor 9, the first detection sensors 11 and 12 detect the bags 6*b* and 7*b* and the second detection sensors 13 and 14 detect the bags 6*a* and 7*a*. Receiving those detection signals, the first and second conveyors 8 and 9 are stopped, the bags 6*b* and 7*b* are positioned at prescribed positions on the belt of the first conveyor 8, and the bags 6*a* and 7*a* are positioned at prescribed positions on the belt of the second conveyor 9.

In the shown embodiment, the number of the bags positioned at one time is equal to 2 rows×2; and thus the positioning conveyor 3 is comprised of two small sub-conveyors (the first and second conveyors 8 and 9). If, generally, the number of bags to be positioned is 2 rows×B (where B is an integer 1 or 2 or greater), the positioning conveyor 3 need only be configured with B sub-conveyors. In order to make the positioning precision (in particular the interval between the previously cut and separated bags 6*a* and 7*a* and the next cut and separated bags 6*b* and 7*b*) definite, it is preferable to configure the positioning conveyor 3 with B sub-conveyors having independent drive mechanisms; however, it is also possible to configure it with only one conveyor. Furthermore, instead of controlling the stopping of the first and second conveyors 8 and 9 (in other words, instead of controlling the bag positioning) by the first and second detection sensors 11 to 14, stoppers can be employed for stopping and positioning the bags on the positioning conveyor 3 comprised of the first and second conveyors 8 and 9.

Furthermore, two sets of first transport means 4 and 5 are provided at symmetrical positions on either side of the first and second conveyors 8 and 9.

More specifically, the first transport means 4 and 5, as shown in FIG. 2, comprise, respectively, turning shafts 15 provided in parallel to the conveyance direction of the first and second conveyors 8 and 9, pairs of swing arms 16 secured perpendicularly to the turning shafts 15, and suction members 17 provided at bent tip ends of the swing arms 16. The suction members 17 are connected either to a vacuum source (not shown) or to the atmosphere through a changeover valve (not shown) from the pipe-form swing arms 16. Each one of the turning shafts 15 is made capable of making reciprocal turns through 90 degrees about its center axis by a drive source (not shown). When the turning shafts 15 make turing, the swing arms 16 swing up and down, within vertical planes, between their horizontal position shown in FIG. 2 and their vertical position shown in FIG. 3.

When the swing arms 16 and 16 have swung downward (so as to turn inwardly each other) and are put into the horizontal position, the suction faces of the suction members 17 face downward and are pushed against and suction-attach to the bags 6*a*, 6b, 7*a* and 7*b* positioned on the first and second conveyors 8 and 9 (see FIG. 2). From there, the swing arms 16 swing upward to the vertical positions (see FIG. 3) so as to upwardly pull out the bags 6*a*, 6*b*, 7*a* and 7*b* along planes perpendicular to the bag surfaces and change the bag attitudes from a horizontal attitude to a vertical attitude wherein the bag mouths are oriented upward. At this time, the bag surfaces of the bags 6*a*, 6*b*, 7*a* and 7*b* are in planes that are parallel to the conveyance direction of the positioning conveyor 3, and the bag surfaces of the bags 6*a* and 7*a* and of the bags 6*b* and 7*b*, respectively, face each other. As seen from the above and shown in FIGS. 2 and 3, the first transport means 4 and 5 operate mutually symmetrically.

As seen from FIG. 1, two sets of second transport means 21 and 22 are provided at symmetrical positions near the first transport means 4 and 5.

Figure 4:
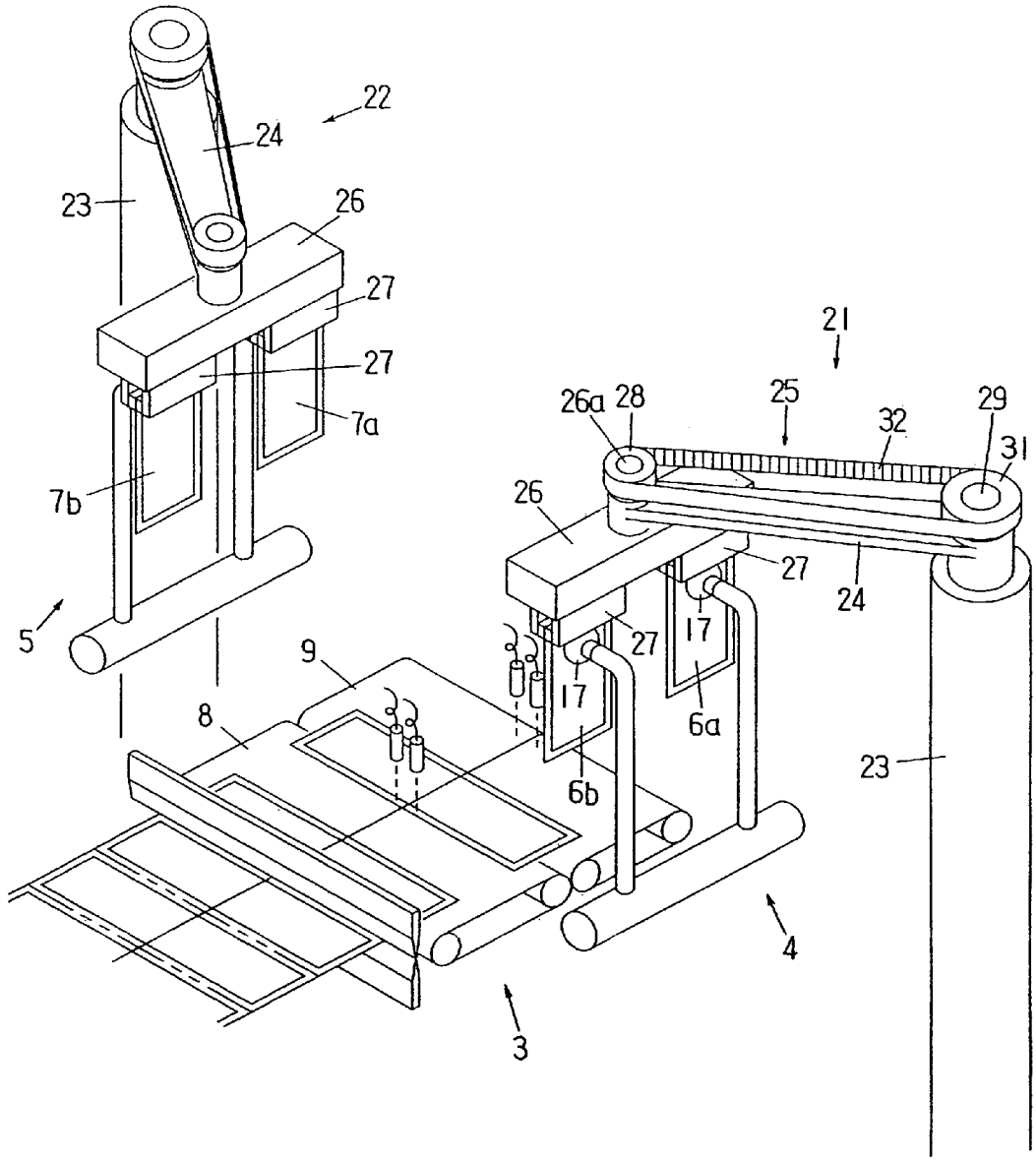
FIG. 4 is a diagram showing, in process step order, the actions of the method and apparatus of the present invention, mainly showing the second transport means.

More specifically, as shown in FIG. 4, the second transport means 21 and 22 are comprised of vertically standing hollow support columns 23, hollow base shafts 20 (see FIG. 1), transport arms 24, support members 26, and two pairs of bag-clamping members 27. The hollow base shafts 20 are provided so as to turn freely inside the support columns 23 and to be driven by a drive source or sources (not shown) and reciprocally turn through prescribed angles in a horizontal plane (see FIG. 1). The transport arms 24 are attached to the base shafts 20 and reciprocally turn through prescribed angles in a horizontal plane in conjunction with the turning of the base shafts 20. The support members 26 have support shafts 26*a* supported so as to freely turn in a horizontal plane at the tip ends of the transport arms 24 and are made capable of reciprocally turning through prescribed angles by drive mechanisms 25. The clamping members 27 are provided on the undersides of the support members 26.

The drive mechanisms 25 are comprised of pulleys 28 secured to the support shafts 26*a*, pulleys 31 secured to turning shafts 29 which are provided so as to freely turn inside the base shafts 20, timing belts 32 extending across the two pulleys 28 and 31, and a drive source (not shown) for rotationally driving the turning shafts 29 through prescribed angles.

The support shafts 26*a* are provided in the center positions in the support members 26. On the undersides of the support member 26, pairs of bag-clamping members 27 for clamping the upper edges of bags from both sides are provided, on the left and right with the support shafts 26*a* in the center. The bag-clamping members 27 are opened and closed by drive mechanisms (not shown) and, when closed, clamp the bags.

In conjunction with the swing motion of the transport arms 24, the support members 26 make movements in a horizontal plane between positions on the first transport means 4 and 5 sides and positions on the third transport means 35 side, which will be described below; and the support members 26 also turn through prescribed angles relative to the transport arms 24 between these movements.

These support members 26 and 26 and the transport arms 24 and 24 of the second transport means 21 and 22 move symmetrically with each other.

As shown in FIG. 4, when the support members 26 and 26, respectively, of the second transport means 21 and 22, have come to the positions on the first transport means 4 and 5 sides, the bag-clamping members 27 and 27 provided in the support member 26 of the second transport means 21 are positioned directly above the bags 6*a* and 6*b* held in the vertical attitude by the first transport means 4, and then the bag-clamping members 27 and 27 close to clamp the bags 6*a* and 6*b*. Meanwhile, the bag-clamping members 27 and 27 provided in the support member 26 of the second transport means 22 are positioned directly above the bags 7*a* and 7*b* held in the vertical attitude by the first transport means 5, and they close to clamp the bags 7*a* and 7*b*. During these operations, the bag surfaces of the bags 6*a*, 6*b*, 7*a* and 7*b* held in the vertical attitude by the first transport means 4 and 5 are in planes that are parallel to the conveyance direction of the positioning conveyor 3, and the clamping surfaces of the support member 26 are likewise in planes that are parallel to the conveyance direction of the positioning conveyor 3.

Figure 5:
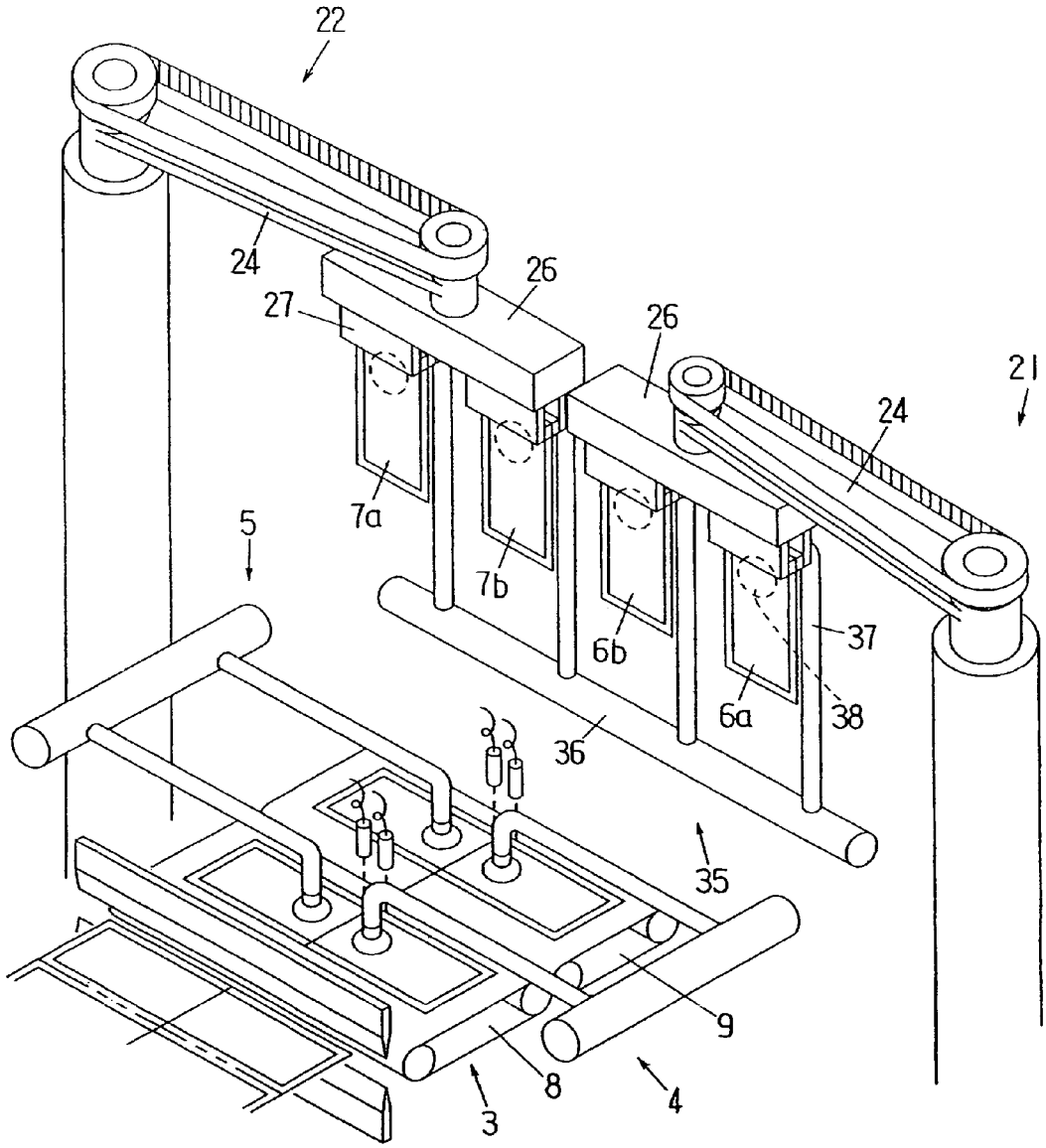
FIG. 5 is a diagram showing, in process step order, the actions of the method and apparatus of the present invention, mainly showing the second transport means.

As shown in FIG. 5, when the respective support members 26 and 26 of the second transport means 21 and 22 have come to positions on the third transport means 35 side, the bags 6*a*, 6*b*, 7*a* and 7*b* clamped by the clamping members 27 have the orientations in which their bag surfaces are changed by 90 degrees to directions that are perpendicular to the conveyance direction of the positioning conveyor 3, so that the bag surfaces are oriented in the feed direction of a feed conveyor 39 described below, and they are aligned in one row in the bag width direction, and the intervals between the bags are constant.

The interval between the bags 6*a* and 6*b* and the interval between the bags 7*a* and 7*b* are previously determined on the positioning conveyor 3. Therefore, in the second transport means 21 and 22, the angle of swing of the transport arms 24, the center of swing of the transport arms 24, and the positional relationship of the first transport means 4 and 5 are set so that the interval between the bags 6*b* and 7*b*, when the bags 6*a*, 6*b*, 7*a* and 7*b* are aligned in one row in the bag width direction, becomes the same as the interval between the bags 6*a* and 6*b* and the interval between the bags 7*a* and 7*b*.

While the transport arms 24 make swing motions, and the support members 26 and 26 move from positions on the first transport means 4 and 5 side to positions on the third transport means 35 side, the bags 6*a*, 6*b*, 7*a* and 7*b* turn 90 degrees in a horizontal plane; however, because the support members 26 turn through a prescribed angle together with the swinging motion of the transport arms 24, the angle of swing of the transport arms 24 can be set to be considerably smaller than 90 degrees. (In order to turn the bags 6*a*, 6*b*, 7*a* and 7*b* through 90 degrees in cases where the support members 26 do not turn, it is necessary to set the angle of swing of the transport arms 24 to 90 degrees). With this setting, the space occupied by the second transport means 21 and 22 is reduced, and the degree of design freedom increases in terms of the conditions for adjusting the interval between the bags 6*b* and 7*b* to be the same as the interval between the bags 6*a* and 6*b* and the interval between the bags 7*a* and 7*b*.

In this shown structure, as seen from the above, the support member 26 of the second transport means 21 turns to the right and the support member 26 of the second transport means 22 turns to the left while the support members 26 and 26 of the second transport means 21 and 22 are moving from positions on the first transport means 4 and 5 side to positions on the third transport means 35 side; as a result, when the support members 26 and 26 have come to the positions on the third transport means 35 side as shown in FIG. 5, the bag surfaces of the bags 6*a*, 6*b*, 7*a* and 7*b* that were first oriented upward (or the bag surfaces that were oriented upward on the positioning conveyor 3) are now oriented to the rearward side of the conveyance direction of the positioning conveyor 3 (or toward the left side in FIG. 5). On the other hand, it is also possible to cause the support member 26 of the second transport means 21 to turn to the left, and the support member 26 of the second transport means 22 to turn to the right. In that case, when the support members 26 and 26 have come to positions on the side of the third transport means 35, the bag surfaces of the bags 6*a*, 7*a*, 6*b* and 7*b* that were first oriented upward are oriented to the forward side in the conveyance direction of the positioning conveyor 3.

As seen from the arrangement of the third transport means 35 (described below), the feed conveyor, and the conveyor magazine-type bag feeder (see FIG. 1), when bags are fed to the packaging machine, the bag surfaces oriented to the rearward side (a direction opposite to the feed direction of the feed conveyor 39 described below) of the bags 6*a*, 6*b*, 7*a* and 7*b* held by the second transport means 21 and 22 in positions on the third transport means 35 side will be oriented to the outside of the packaging machine. In, for example, such a case that it is necessary to apply printing on a bag surface in the packaging machine, bags are generally fed into the packaging machine so that the bag surfaces to be printed (either the front or back surface) are oriented toward the outside of the packaging machine; however, by setting the direction of turning of the support member 26 and 26 to a desired direction, it becomes possible to print on either the front surfaces or the back surfaces of the bags.

In the above-described structure, moreover, the turnings of the support members 26 and 26 with respect to the transport arms 24 and 24 are made by the drive mechanisms 25 that include a drive source (not shown). However, by fixing the pulleys 31 so that they do not turn relative to the support columns 23, and suitably setting the pulley ratios between the pulleys 28 and the pulleys 31, the support members 26 can be made to turn through prescribed angles in conjunction with the swing motion of the transport arms 24 without the above-described drive source. In this case, however, the turning angle of the support members 26 relative to the transport arms 24 and the direction of the turning are not able to be changed freely.

The third transport means 35 is provided near the second transport means 21 and 22.

Figure 6:
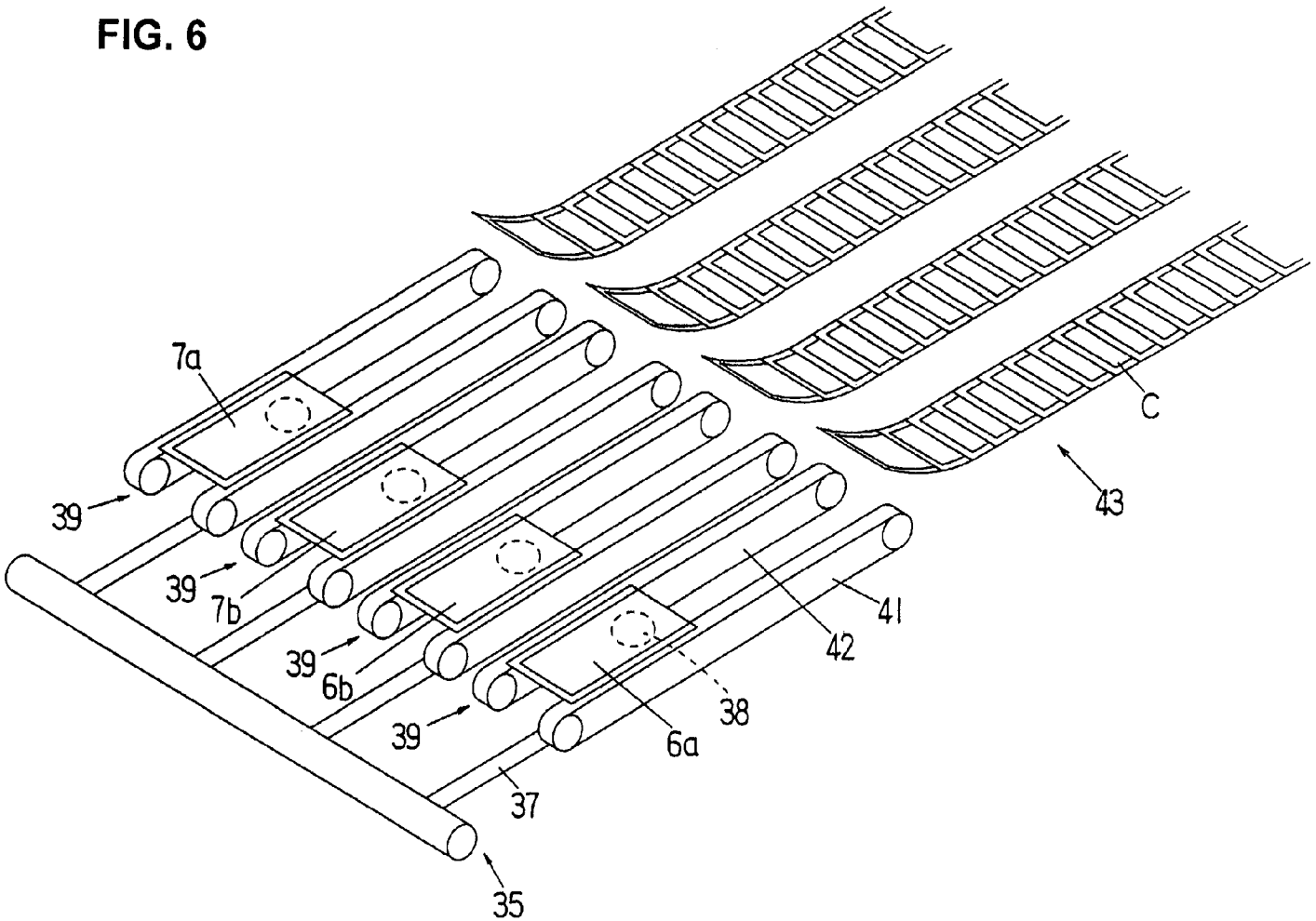
FIG. 6 is a diagram showing, in process step order, the actions of the method and apparatus of the present invention, mainly showing the third transport means.

More specifically, the third transport means 35, as seen from FIGS. 5 and 6, comprises a turning shaft 36 provided horizontally and at right angles with respect to the conveyance direction of the first and second conveyors 8 and 9, four swing arms 37 secured at right angles with respect to the turning shaft 36, and suction members 38 provided at bent tip ends of the swing arms 37. The suction members 38 are connected to a vacuum source (not shown) or the atmosphere through a changeover valve (not shown) from the pipe-form swing arms 37. The turning shaft 36 is capable of making reciprocal turns through 90 degrees by a drive source (not shown); and in conjunction with this turning of the turning shaft 36, the swing arms 37 swing up and down in vertical planes parallel to the conveyance direction of the positioning conveyor 3 and between the vertical positions shown in FIG. 5 and the horizontal positions shown in FIG. 6.

When the turning shaft 36 rotates rearward and the swing arms 37 thus swing to the vertical positions, the suction faces of the four suction members 38 face rearward (or to the direction of the second transport means 21 and 22) and suck onto the bag surfaces (which could also be called the bag surfaces oriented in the feed direction of the feed conveyor 39, or the bag surfaces oriented toward the forward side of the conveyance direction of the positioning conveyor 3 as seen from FIG. 5) of the bags 6*a*, 6*b*, 7*a* and 7*b* clamped by the bag-clamping members 27 of the second transport means 21 and 22. From this position, the swing arms 37 swing downward (to face forward) by the forward rotation of the turning shaft 36, the bags 6*a*, 6*b*, 7*a* and 7*b* are moved downward along vertical planes that are parallel to the conveyance direction of the positioning conveyor 3, the suction members 38 become upward facing, while still holding the bags 6*a*, 6*b*, 7*a* and 7*b*, and thus the attitudes of the bags 6*a*, 6*b*, 7*a* and 7*b* are changed from a vertical attitude to a horizontal attitude (see FIG. 6), and the bags 6*a*, 6*b*, 7*a* and 7*b* are all placed on the feed conveyor 39 with their bag mouths oriented in the feed direction.

As shown in FIG. 6, four sets of feed conveyors 39, corresponding to the suction members 38 of the third transport means 35, are provided near the third transport means 35. The conveyance direction of the feed conveyors 39 coincides with the direction of orientation of the bag mouths of the bags 6*a*, 6*b*, 7*a* and 7*b* held by the third transport means 35 and placed on the feed conveyors 39.

Each feed conveyor 39 comprises a pair of conveyor belts 41 and 42 separated by a prescribed distance; and as shown in FIG. 6, the feed conveyor 39 is designed so that a portion of the swing arm 37 and a suction member 38 can advance into the gap in the middle of the conveyor belts 41 and 42. As a result, the bags 6*a*, 6*b*, 7*a* and 7*b* suction-held by the suction members 38 can be placed on the feed conveyors 39 (on the conveyor belts 41 and 42) without interference. The bags 6*a*,6*b*, 7*a* and 7*b* placed on the feed conveyors 39 are transported forward (see FIG. 7).

Corresponding to the feed conveyors 39, four conveyor magazine-type bag feeders 43, themselves being publicly known, are provided. The structure of the conveyor magazine-type bag feeder 43 is not shown in the drawings, and shown in the drawings is bag groups (pluralities of bags) C stacked on belt conveyors, which are part of the conveyor magazine-type bag feeder 43, in such a fashion that the upper bags are successively staggered in the direction of the bag mouths with the bag mouths oriented forward.

Figure 8:
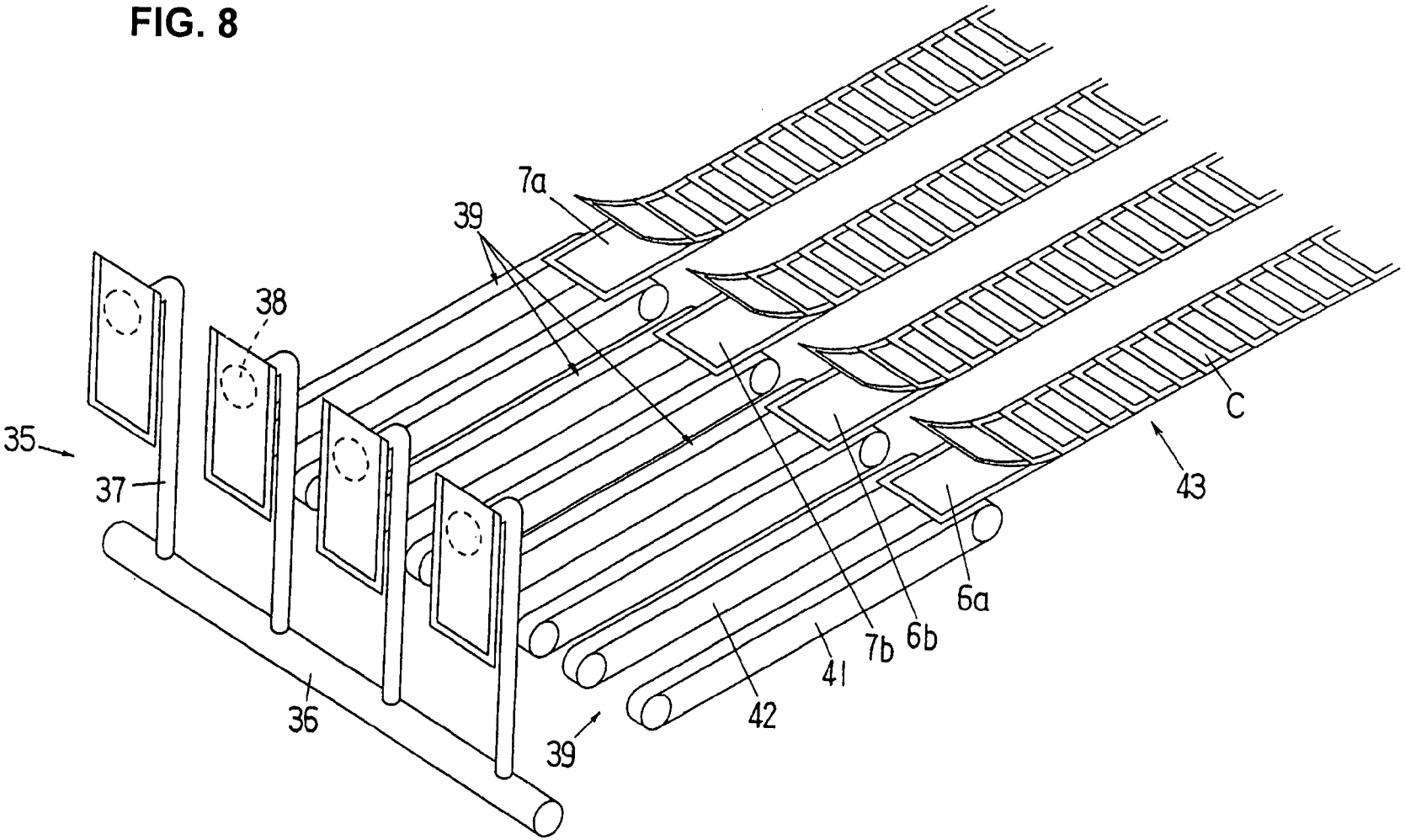
FIG. 8 is a diagram showing, in process step order, the actions of the method and apparatus of the present invention.

As shown in FIG. 8, in particular, synchronized with the feeding in of the bags from the feed conveyors 39, the rearmost end bags in the bag groups C are lifted up by lifting arms (not shown in the drawings, but as disclosed in Japanese Patent Application Laid-Open No. H08-337217), and the bags 6*a,* 6*b,* 7*a* and 7*b* on the feed conveyors 39 are fed in between the conveyor magazine-type bag feeders 43 and the above-described rearmost end bags.

Next, the overall actions of the bag feeding apparatus detailed above will be described simply with reference to FIGS. 2 to 8.

(1) As shown in FIG. 2, in the horizontal bag-making machine 1, two rows of connected bags 6 and 7 are formed from belt-shaped film, and the leading bags are successively cut and separated. The bags 6*a,* 7*a,* 6*b* and 7*b* are fed out from the horizontal bag-making machine 1 onto the positioning conveyor 3 and conveyed by the positioning conveyor 3 (comprising the first conveyor 8 and the second conveyor 9) so that the bags are positioned at prescribed positions on the positioning conveyor 3. Then, the first transport means 4 and 5 are activated and the suction members 17 suck and hold the positioned bags 6*a,* 7*a,* 6*b* and 7*b*.

Figure 3:
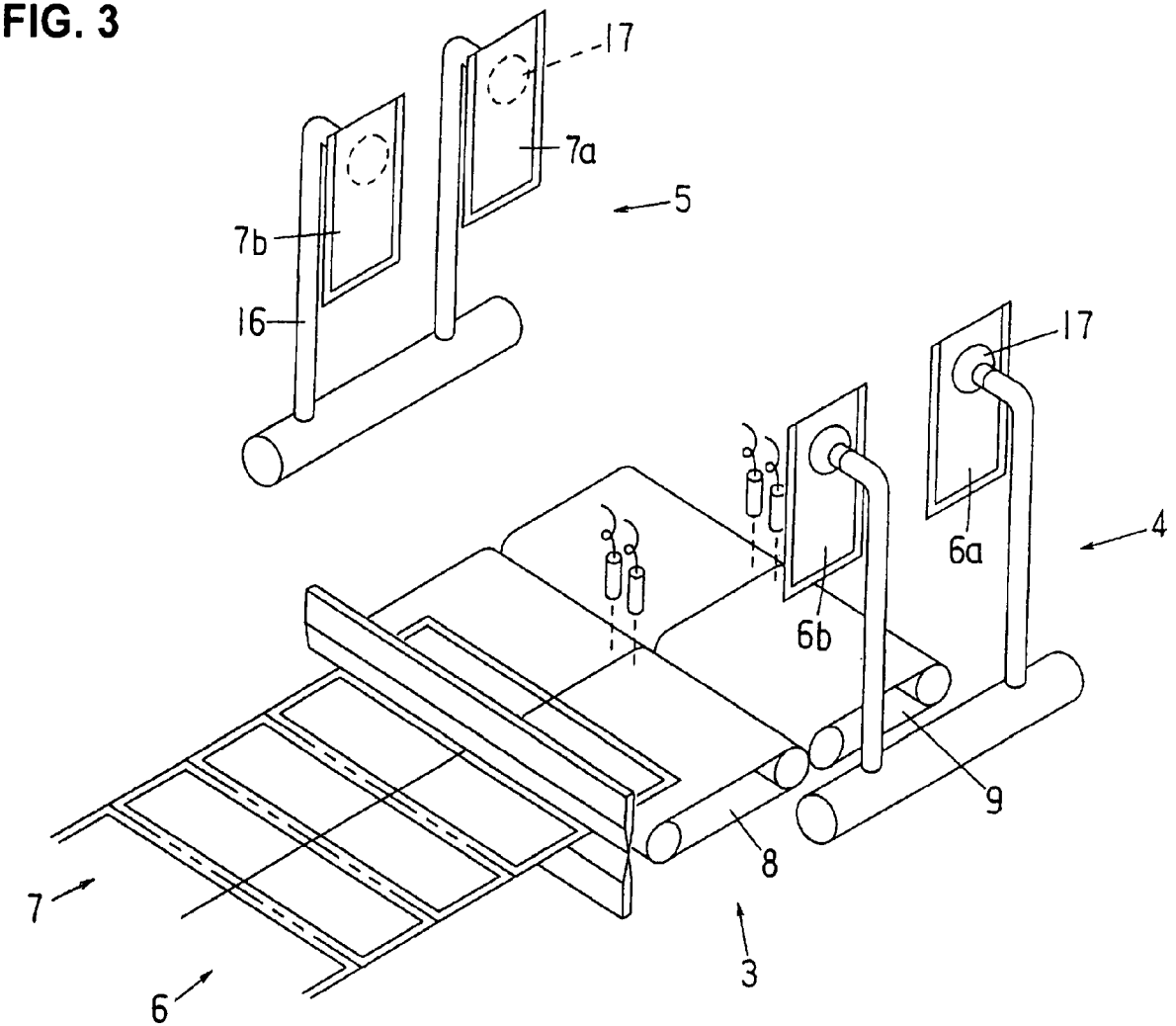
FIG. 3 is a diagram showing, in process step order, the actions of the method and apparatus of the present invention, mainly showing the first transport means.

(2) As shown in FIG. 3, the swing arms 16 of the first transport means 4 and 5 next swing upward, upwardly pull out the suction-held bags 6*a,* 6*b,* 7*a* and 7*b,* and then change the attitude of the bags from a horizontal attitude, which is of on the positioning conveyor 3, to a vertical attitude, in which the bag mouths are oriented upward.

(3) As shown in FIG. 4, the transport arms 24 of the second transport means 21 and 22 swing to positions which are on the first transport means 4 and 5 side, and the bag-clamping members 27 close to clamp the bags 6*a,* 6*b,* 7*a* and 7*b* at their upper edges. Next, the suction of the suction members 17 of the first transport means 4 and 5 stops, releasing the bags 6*a,* 6*b,* 7*a* and 7*b,* so that the bags 6*a,* 6*b,* 7*a* and 7*b* can be passed to the second transport means 21 and 22. At this time, the next set of bags are already being fed out from the horizontal bag-making machine 1 onto the positioning conveyor 3.

(4) As seen from FIG. 5, the transport arms 24 of the second transport means 21 and 22 swing, so that the bags 6*a,* 6*b,* 7*a* and 7*b* held by the second transport means 21 and 22 are transported to prescribed positions (to positions where they are passed to the third transport means 35) in the horizontal direction with their vertical attitudes unchanged; and while the bags are being transported, they are rotated in a horizontal plane to change their orientation by 90 degrees. At this time, one of the bag surfaces of each of the bags 6*a,* 6*b,* 7*a* and 7*b* faces in the feed direction of the feed conveyors 39 which is provided on the forward direction or downstream side. At the prescribed positions noted above, the third transport means 35 are already standing by (with the swing arms 37 swinging to the vertical position), and the bag surfaces on the forward sides of the bags 6*a,* 6*b,* 7*a* and 7*b* held in the vertical attitude by the second transport means 21 and 22 (the bag surfaces facing in the feed direction of the feed conveyors 39) are sucked onto by the suction members 38. Next, the bag-clamping members 27 of the second transport means 21 and 22 open, releasing the bags 6*a,* 6*b,* 7*a* and 7*b,* so that the bags 6*a,* 6*b,* 7*a* and 7*b* are passed to the third transport means 35. At this time, the first transport means 4 and 5 are already activated, and the next four bags positioned on the positioning conveyor 3 are sucked onto by the suction members 17.

(5) As shown in FIG. 6, the swing arms 37 of the third transport means 35 swing to the horizontal position, changing the attitudes of the bags 6*a,* 6*b,* 7*a* and 7*b,* while holding them, from the vertical attitude with the bag mouths oriented upward to the horizontal attitude, and placing the bags on the feed conveyors 39 with the bag mouths oriented forward (in the feed direction of the feed conveyors 39). The suction of the suction members 38 then stops, thus releasing the bags 6*a,* 6*b,* 7*a* and 7*b*.

Figure 7:
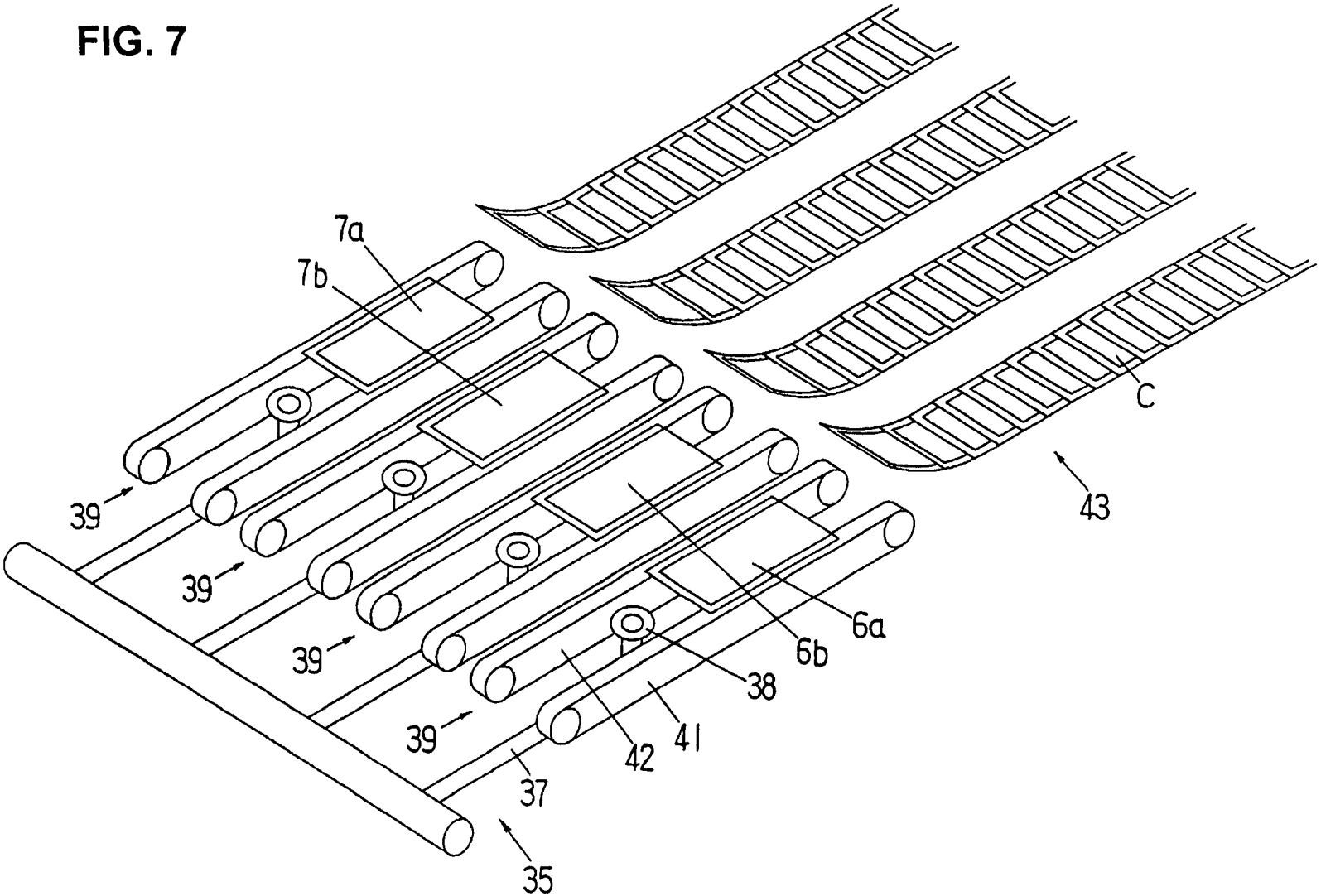
FIG. 7 is a diagram showing, in process step order, the actions of the method and apparatus of the present invention, mainly showing the third transport means.

(6) As shown in FIG. 7, the bags 6*a,* 6*b,* 7*a* and 7*b,* with their bag mouths oriented forward, are conveyed by the feed conveyors 39 to the belt conveyors of the conveyor magazine-type bag feeders 43.

(7) As shown in FIG. 8, from the feed conveyors 39, the bags 6*a,* 6*b,* 7*a* and 7*b,* with their bag mouths oriented forward, are fed onto the belt conveyors of the conveyor magazine-type bag feeders 43.

In the embodiment described above, the horizontal bag-making machine is a two-row type, the orientation of the bags manufactured and fed out and the orientation of the bags in the conveyor magazine-type bag feeder are different by 90 degrees, the orientations of the bags themselves that are fed out in parallel in two rows differ by 180 degrees, and the number of belt conveyors in the conveyor magazine-type bag feeder is four (the number of bags to be fed at one time being four). Nevertheless, the present invention, needless to say, can be applied generally to other combinations of horizontal bag-making machines and packaging machines.

The invention claimed is:

1. A method for feeding bags to a packaging machine, comprising the steps of:

forming connected bags, in which bags are connected in a belt shape, in a horizontal bag-making machine while belt-shaped film is fed, successively, in its longitudinal direction;

cutting and separating individual bags from said connected bags in said horizontal bag-making machine;

allowing the bags fed out from said horizontal bag-making machine to be received on a conveyor and conveyed and then effecting positioning of the bags at a prescribed position on said conveyor;

upwardly pulling out positioned bags, and changing attitudes of the bags to a vertical attitude in which bag mouths are oriented upward;

moving the bags in a horizontal direction, toward a prescribed position, while the vertical attitude thereof is maintained;

rotating the bags to orient one bag surface toward a next feed direction;

changing the attitude of the bags from vertical to horizontal so that the bag mouths are oriented in a feed direction, and placing the bags on a feed conveyor; and conveying and feeding the bags on said feed conveyor toward a belt conveyor of a conveyor magazine-type bag feeder of the packaging machine.

2. The method for feeding bags to a packaging machine according to claim 1, wherein said step of moving the bags in a horizontal direction, toward a prescribed position, while the vertical attitude thereof is maintained and said step of rotating the bags to orient one bag surface toward a next feed direction are executed simultaneously.

3. An apparatus for feeding bags to a packaging machine, the apparatus comprising:

a horizontal bag-making machine for forming connected bags such that bag are connected in a belt shape, while feeding belt-shaped film, successively, in a longitudinal direction of the film and for cutting and separating individual bags from said connected bags;

a positioning conveyor for conveying bags fed out from said horizontal bag-making machine and positioning the bags in a prescribed position;

a feed conveyor for conveying and successively feeding bags manufactured by said horizontal bag-making machine toward a belt conveyor of a conveyor magazine-type bag feeder of a packaging machine and successively feeding the bags; and a first, second, and third transport means provided between said positioning conveyor and feed conveyor, wherein said first transport means comprises a swing arm that swings up and down in a vertical plane, and a suction member provided on said swing arm and capable of sucking onto a bag surface, so that said first transport means upwardly pulls out bags positioned on said positioning conveyor, and changes an attitude of the bags to a vertical attitude in which bag mouth are oriented upward;

said second transport means comprises a transport arm that swings in a horizontal plane, a support member provided in said transport arm so as to turn in a horizontal plane, and a bag-clamping member provided in said support member and capable of opening and closing, so that said second transport means clamps onto and receives bags held in the vertical attitude by said suction member, transports the bags toward a prescribed position while the bags are being held in the vertical attitude, and rotates the bags to orient a bag surface thereof in a feed direction of said feed conveyor; and said third transport means comprises a swing arm that swings up and down in a vertical plane, and a suction member provided in said swing arm and capable of sucking onto the bag surface, so that said third transport means sucks onto and receives bags held in the vertical attitude by said bag-clamping member, changes the attitude of the bags to a horizontal attitude, orients the bag mouths in the feed direction of said feed conveyor, and places the bags on said feed conveyor.

4. The apparatus for feeding bags to a packaging machine according to claim 3, wherein said horizontal bag-making machine forms connected bags in A rows (where A is 1 or 2), then cuts and separates individual bags from the connected bags;

B bags (where B is an integer that is 1 or 2 or greater) are positioned, in said positioning conveyor, along a conveyance direction of said positioning conveyor, for each row of bags fed out from said horizontal bag-making machine;

said conveyor magazine-type bag feeder is provided in a number equal to A×B;

said feed conveyor is provided corresponding to the belt conveyor of each conveyor magazine-type bag feeder;

said first and second transport means are respectively provided in A groups so as to correspond to the rows of bags fed out from said horizontal bag-making machine;

a suction member is provided in said swing arm of each of said first transport means corresponding to B bags positioned along the conveyance direction on said positioning conveyor;

a bag-clamping member, corresponding to B bags sucked onto by a suction means of said first transport means, is provided in said support member of each of said second transport means; and a suction member, corresponding to A×B number of bags held by said bag clamping means, is provided in the swing arm of said third transport means.

5. The apparatus for feeding bags to a packaging machine according to claim 4, wherein said positioning conveyor comprises B sub-conveyors provided in series in the conveyance direction, and bags are positioned on each sub-conveyor one at a time.

6. The apparatus for feeding bags to a packaging machine according to claim 3, wherein said support member in said second transport means turns simultaneously with a swing motion of said transport arm.

7. The apparatus for feeding bags to a packaging machine according to claim 6, wherein, in said third transport means, said suction member sucks onto bag surfaces oriented in the feed direction of said feed conveyor, and said feed conveyor has a pair of conveyor belts provided so as to be separated by a prescribed distance, so that when said swing arm swings downward a part of said swing arm and the suction member can advance into a gap in a middle of said pair of conveyor belts.

8. The apparatus for feeding bags to a packaging machine according to claim 3, wherein, in said third transport means, said suction member sucks onto bag surfaces oriented in the feed direction of said feed conveyor, and said feed conveyor has a pair of conveyor belts provided so as to be separated by a prescribed distance, so that when said swing arm swings downward a part of said swing arm and the suction member can advance into a gap in a middle of said pair of conveyor belts.

* * * * *